United States Patent [19]

Gorski

[11] Patent Number: 4,847,937

[45] Date of Patent: Jul. 18, 1989

[54] HAIR BRUSH

[75] Inventor: Elmar Gorski, Solingen, Fed. Rep. of Germany

[73] Assignee: Christel Mütze, Solingen, Fed. Rep. of Germany

[21] Appl. No.: 217,519

[22] Filed: Jul. 7, 1988

[30] Foreign Application Priority Data

Jul. 11, 1987 [DE] Fed. Rep. of Germany ..... 3723049

[51] Int. Cl.[4] ..... A46B 9/10

[52] U.S. Cl. ..... 15/203

[58] Field of Search ..... 15/169, 184, 201, 203, 15/159 A; 132/119–123, 129, 85

[56] References Cited

U.S. PATENT DOCUMENTS

| | | | |
|---|---|---|---|
| 1,592,510 | 7/1926 | Toepperwein | 15/203 |
| 4,121,314 | 10/1978 | Nathe | 15/203 |
| 4,214,340 | 7/1980 | Youngberg et al. | 15/184 |

FOREIGN PATENT DOCUMENTS

| | | | |
|---|---|---|---|
| 152193 | 4/1903 | Fed. Rep. of Germany | 15/203 |
| 418966 | 11/1934 | United Kingdom | 15/203 |

*Primary Examiner*—Peter Feldman
*Attorney, Agent, or Firm*—John C. Smith, Jr.

[57] ABSTRACT

In the case of hair brushes the arcuately shaped bristle members of which are studded with bristles, mounted in the side walls of a housing being U-shaped in cross section, are arranged in a plurality adjacently and with a distance from one another and are pivotable by means of a slide guided in the housing below these bristle members from a position of non-use into a position of use, this pivoting into the position of use and back into the position of non-use is complicated and time-consuming.

This disadvantage is eliminated in that the slide has at its longitudinal edges edge cutouts facing one another, the bristle members resting between these edge cutouts on the slide in such a manner so as to be secured against unintended pivot movement. The slide can be approached with its edge cutouts to the ends of the bristle members by sliding movement in such a manner that the bristle members, by a sliding pressure by hand on the bristles, obliquely engage in the edge cutouts in the position of non-use. From this position the bristle members are pivoted, by moving the slide, into the initial position, i.e. the position of use of the bristles.

7 Claims, 2 Drawing Sheets

HAIR BRUSH

BACKGROUND OF THE INVENTION

This invention relates to a hair brush having a stalk-like handle and a plurality of bristles which are mounted on arcuately shaped, pivotably mounted bristle members, the bristle members being mounted in a longitudinal housing which is U-shaped in cross section and open at one of its ends, said bristle members are arranged in a plurality adjacently and with a distance relative to one another and may be pivoted by means of a slide guided in the housing below the bristle members from a position of non-use in which the bristles are arranged obliquely one upon the other into a position of use in which the bristles extend beyond the housing at its top edge in a vertical or approximately vertical manner.

Such hair brushes are particularly suited for being carried or stored in a handbag or a pocket, in which they can be placed in a space-saving manner due to the pivotability of the bristles into a position of non-use when the hair brush is not in use.

From British Patent Application No. A 2,173,092 a hair brush is already known in which the bristles members are pivotably mounted with their ends in the longitudinal side walls of a housing which is U-shaped in cross section. In the position of non-use, the bristles lie flatly between a slide guided in the housing and the bottom of the housing. In order to bring the bristles in the position of use, the slide has to be pulled out of the housing and turned by 180°, thereafter it is again pushed into the housing, namely between the bristle members and the bottom of the housing. In doing so, the bristles are erected due to lever action into the position of use. This kind of securing the bristles in the position of non-use and bringing the bristles into the position of use is complicated and time-consuming.

Furthermore, from U.S. Pat. No. 4,121,314 a hair brush is known in which the longitudinal bristle members which are mounted in the side surfaces of the housing with U-shaped cross section rest vertically on the slide in the position of use of the bristles. In order to bring the bristles in the position of non-use, the slide has to be pulled out of the lower part of the housing and pushed into the upper part of the housing, in doing so, the bristle members with the bristles are pivoted into an oblique position, i.e. into the position of non-use. This kind of bringing the bristle members and the bristles into a position of use and back into a position of non-use is likewise complicated and time-consuming.

From U.S. Pat. No. 4,214,340, there is further known a hair brush in which the bristles are arranged on a single longitudinal bristle carrier formed as a slide which is slidable up and down in a housing being open at its top by means of a dial provided at the outside of the housing in order to bring the bristles in the positions of use and non-use. Due to this, the constructional height of the housing must be relatively large because the bristles must be moved over their whole length into the housing in order to bring them in the position of non-use. This hair brush is therefore not only bulky but has also a relatively high weight.

SUMMARY OF THE INVENTION

It is, therefore, the object of the present invention to avoid the above-mentioned disadvantages and to provide a hair brush of the kind mentioned at the beginning which simplifies the pivoting of the bristles into the position of use and the position of non-use.

To attain this object the present invention provides a hair brush having a stalk-like flat handle and a plurality of bristles which are mounted on arcuately shaped, pivotably mounted bristle members, the bristle members being mounted in a longitudinal housing which is U-shaped in cross section and open at one of its ends, said bristle members being arranged in a plurality adjacently and with a distance relative to one another and may be pivoted by means of a slide guided in said housing below the bristle members from a position of non-use in which the bristles are arranged obliquely one upon the other into a position of use in which the bristles extend beyond the housing at its top edge in a substantially vertical manner, wherein the slide has at each of its longitudinal edges a number of edge cutouts facing one another, the bristle members resting between said edge cutouts on the slide in a manner so as to be secured against unintended pivot movement in the position of use of the bristles, the slide being able to be approached with its edge cutouts to the ends of the bristle members by sliding movement in such a manner that the bristle members, by a sliding pressure by hand on the bristles, obliquely engage in the edge cutouts in the position of non-use of the bristles, from which position the bristle members are pivoted by moving the slide into the initial position until they rest again on the slide, and the stalk-like flat handle being pivotably arranged with one of its ends having a circular disc secured thereto in a circular opening provided in the bottom of the housing, said circular disc being provided with an eccentrically arranged hole, a pin which passes through a longitudinal opening provided in the slide transversely to its longitudinal axis engaging into said hole and resting against the slide at that side facing away from the circular disc with an integrally formed enlarged head.

The hair brush proposed by the invention has the advantage as compared with the known hair brushes having a slide that merely by moving the slide by means of the handle the bristles are brought from the position of non-use into the position of use, whilst by a simple sliding pressure by hand on the bristles these are pivoted into the position of non-use.

In an advantageous development, the handle has at its broad side facing the bottom of the housing two pins with self-resiliency which are arranged in the longitudinal axis of the handle at both sides of its connection to the slide, said pins cooperating with recesses provided at the outside of the bottom of the housing.

In the position of use, the handle engages with the pins into the recesses provided in the outside of the bottom of the housing of the hair brush so that it is secured against unintended pivot movement. In the same manner the handle is secured in the position of non-use in which it rests over its length against the outside of the bottom of the housing.

BRIEF DESCRIPTION OF THE DRAWINGS

An embodiment of the invention will now be described by way of example and with reference to the accompanying drawings in which.

DESCRIPTION OF THE PREFERRED EMBODIMENT

Figure 1:
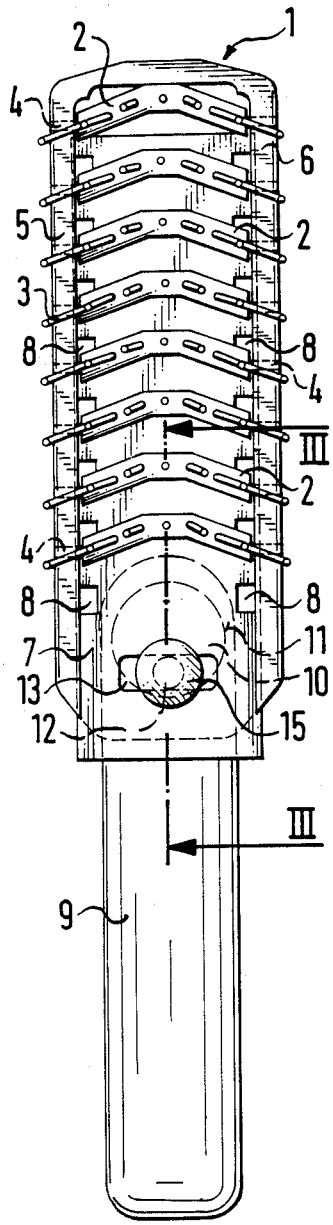
FIG. 1 is an elevational view of a hair brush according to the present invention with a handle and bristles in the position of use.
Figure 2:
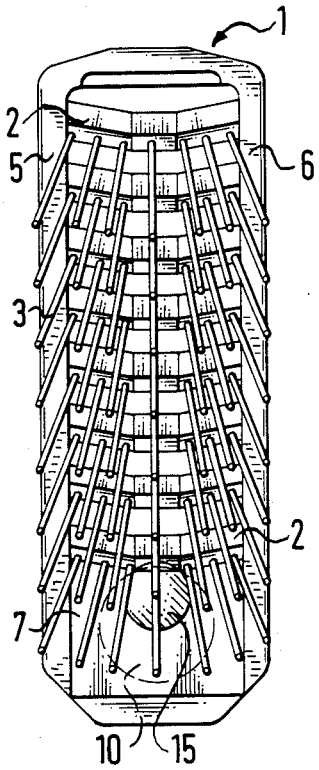
FIG. 2 is an elevational view of the hair brush of FIG. 1 with the bristles in the position of non-use.
Figure 3:
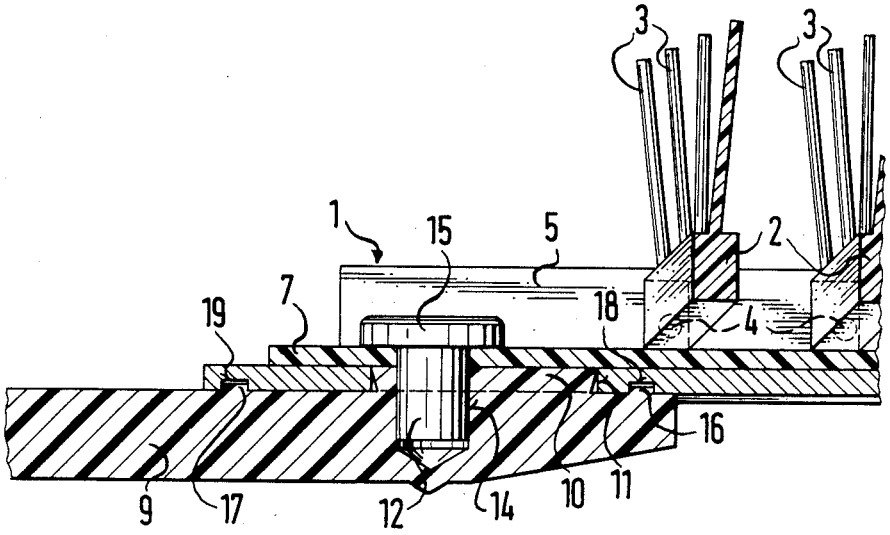
FIG. 3 is a sectional view on the line III—III of FIG. 1.
Figure 4:
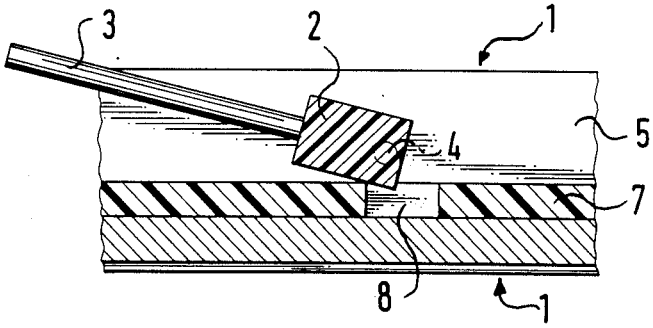
FIG. 4 is a sectional view of a structural detail.

FIGS. 1 to 4 show a hair brush comprising a housing 1 which is U-shaped in cross section and made of plastic material and arcuately shaped bristle members 2 likewise made of plastic material. The bristle members 2 are studded with bristles 3. The bristle members 2 comprise at their ends pivot pins 4 which are formed in one piece with said bristle members 2. The bristle members 2 are mounted by means of the pivot pins 4 with a distance from one another and adjacent to one another in a longitudinal side walls 5 and 6 of the housing 1. In the housing 1 there is mounted below the bristle members 2 a slide 7 consisting of plastic material and having at its longitudinal edges edge cutouts 8 facing one another. At one of the ends of the slide 7 there is arranged a stalk-like flat handle 9 of plastic material. This handle 9 possesses at one of its ends a circular disc 10 formed integrally therewith by means of which it is guided in a circular opening 11 provided in the bottom of the housing 1. The connection between the handle 9 and the slide 7 is effected by means of a pin 12 which likewise consists of plastic material and which passes through a longitudinal opening 13 of the slide 7 extending transversely of the longitudinal axis of the slide 7, with its one end the pin 12 engaging into a hole 14 eccentrically arranged in the disc 10. At its other end, the pin 12 possesses an integraly formed enlarged head 15 by means of which it rests against the upper side of the slide 7. The handle 9 comprises at its broad side facing the bottom of the housing 1 two pins 16 and 17 with self-resiliency which are arranged in the longitudinal axis of the handle 9 at both sides of the pivotable connection of the handle 9 with the slide 7, said pins 16 and 17 cooperating with recesses 18 and 19 provided at the outside of the bottom of the housing 1.

When the hair brush is not in use, the handle 9 rests over its length against the outside of the bottom of the housing 1. It is secured in this position against unintended pivot movements by the engagement of the pins 16 and 17 in the recesses 18 and 19 at the bottom of the housing 1. By a sliding pressure with the hand on the bristles 3, the bristle members 2 are pivoted to such an extent until they rest with their ends obliquely in the edge cutouts 8 of the slide 7 (FIG. 4) associated with them. By the sliding pressure on the bristles 3 they are at the same time turned so far until they are positioned obliquely one upon the other. In order to take the hair brush in use, the handle 9 is pivoted by 180°, the pins 16 and 17 thereby disengaging from the recesses 18 and 19, and, after the working position of the handle 9 has been reached, again engage in the recesses 18 and 19. During the pivot movement of the handle 9, the slide 7 is taken along, i.e. it is pulled out of the housing 1 to a small extent. Thereby, the bristle members 2 are again pivoted into their initial position by lateral pressure on their ends by means of the slide 7, in which initial position they are seated with their ends vertically and unremovably on the slide 7 at that part which is located between two edge cutouts 8. The bristles 3 are now again erected so that the hair brush can now be used. In order to be able to put away the hair brush in a spacesaving manner, the handle 9 is again pivoted into the initial position to such an extent that the pins 16 and 17 which were disengaged from the recesses 18 and 19 again engage in these recesses 18 and 19. The slide 7 is again pushed into the housing 1, and the bristle members 2, by a sliding pressure by hand on the bristles 3, are pivoted to such an extent until they rest with their ends obliquely in the edge cutouts 8 of the slide 7.

The invention may be embodied in other specific forms without departing from the spirit or essential characteristics thereof. The embodiment is therefore to be considered in all respects as illustrative and not restrictive.

What is claimed is:

1. A hair brush having a stalk-like flat handle and a plurality of bristles which are mounted on arcuately shaped, pivotably mounted bristle members, the bristle members being mounted in a longitudinal housing which is U-shaped in cross section and open at one of its ends, said bristle members being arranged in a plurality adjacently and with a distance relative to one another and may be pivoted by means of a slide guided in said housing below the bristle members from a position of non-use in which the bristles are arranged obliquely one upon the other into a position of use in which the bristles extend beyond the housing at its top edge in a substantially vertical manner, wherein (a) the slide has at each of its two longitudinal edges a number of edge cutouts facing one another, the bristle members resting between said edge cutouts on the slide in a manner so as to be secured against unintended pivot movement in the position of use of the bristles, the slide being able to be approached with its edge cutouts to the ends of the bristle members by sliding movement in such a manner that the bristle members, by a sliding pressure by hand on the bristles, obliquely engage in the edge cutouts in the position of non-use of the bristles, from which position the bristle members are pivoted by moving the slide into the initial position until they rest again on the slide, (b) the stalk-like flat handle being pivotably arranged with one of its ends having a circular disc secured thereto in a circular opening provided in the bottom of the housing, said circular disc being provided with an eccentrically arranged hole, a pin which passes through a longitudinal opening provided in the slide transversely to its longitudinal axis engaging into said hole and resting against the slide at that side facing away from the circular disc with an integrally formed enlarged head, and (c) the handle having at its broad side facing the bottom of the housing two pins with self-resiliency which are arranged in the longitudinal axis of the handle at both sides of its connection to the slide, said pins cooperating with recesses provided at the outside of the bottom of the housing.

2. A hair brush comprising:

(a) an elongated housing member having oppositely facing lower and upper faces and a pair of elongated members spaced from each other and projecting upwardly from the opposite longitudinal sides thereof;

(b) a plurality of bristle support members spaced from each other and spaced from said upper face of said housing member, each support member being pivotally mounted at opposite ends on respective of said elongated members, supporting a plurality of bristles projecting from one side thereof and the opposite side thereof having a substantially flat surface, said surface of each of said support members being on opposite sides of a line transverse to said surface and passing through the pivotal axis of said support member; and (c) an elongated slide member disposed between said upper face of said housing member and said plurality of bristle support members and adapted to slide longitudinally therebetween, the lower face of said slide member confronting said upper face of said housing and the upper face of said slide member contacting at least a portion of said flat surfaces of said plurality of bristle support members such that said upper surface of said slide member prevents pivotal movement of said bristle support members, said upper surface of said slide member having a plurality of cutouts at spaced intervals corresponding to the spaced intervals between said bristle support members whereby when said slide member is positioned such that said spaced cutouts register with said bristle support members said bristle support members may be pivoted to positions wherein the bristles on each support member are oriented obliquely with respect to the bristles on adjacent support members;

(d) whereby said bristles may be extended when said brush is in use and retracted when said brush is not in use.

3. A hair brush according to claim 2 further comprising:

(a) a handle pivotally mounted on said housing for pivotal movement between retracted and extended positions; and (b) means connecting said handle and said slide member for moving said slide member between a position where said cutouts in said slide member are in registry with said plurality of pivotally mounted bristle support members and a position where the portions of said upper surface of said slide member between said cutouts are in registry with said bristle support members when said handle is pivoted between said retracted and extended positions;

(c) whereby said bristles and handle may be extended when said brush is in use and retracted when said brush is not in use.

4. A hair brush according to claim 3 wherein said bristles support members each have an arcuate configuration and said plurality of cutouts are arranged adjacent opposite edges of said upper surface of said slide member for registry with opposite ends of each of said bristle support members.

5. A hair brush according to claim 3 wherein said means connecting said handle and said slide member for moving said slide member when said handle is pivoted comprises eccentric means.

6. A hair brush comprising:

(a) a housing including a pair of elongated members spaced from each other;

(b) a plurality of arcuately shaped bristle support members spaced from each other and pivotally mounted at opposite ends on respective of said elongated members, a plurality of bristles projecting from one side of each of said support members, the surface of each of said bristle support members, opposite said bristles and adjacent the opposite ends of said bristle support members, being on opposite sides of a line transverse to said surface and passing through the pivotal axis of said support member;

(c) a slide member slidable between first and second positions in said housing and having a surface for contacting at least a portion of the sides of each said plurality of bristle support members opposite said one side thereof for preventing pivotal movement of said bristle support members when said slide member is in said first position, said surface of said slide member adjacent said bristle support members having a plurality of cutouts at spaced intervals corresponding to the spaced intervals between said ends of said bristle support members, whereby when said slide member is in said second position said spaced cutouts register with said ends of said bristle support members permitting said bristle support members to be pivoted to positions wherein the bristles on each support member are oriented obliquely with respect to the bristles on adjacent support members;

(d) whereby said bristles may be extended when said brush is in use and retracted when said brush is not in use.

7. A hair brush according to claim 6 further comprising:

(a) a handle pivotally mounted on said housing for pivotal movement between retracted and extended positions; and (b) means connecting said handle and said slide member for moving said slide member between said first and second positions when said handle is pivoted between said retracted and extended positions;

(c) whereby said bristles and handle may be extended when said brush is in use and retracted when said brush is not in use.

* * * * *